US010683755B2

(12) United States Patent
Sobey, Jr. et al.

(10) Patent No.: US 10,683,755 B2
(45) Date of Patent: Jun. 16, 2020

(54) CONTINUOUSLY VARIABLE TURBINE

(71) Applicant: PDT, LLC, Bloomfield Hills, MI (US)

(72) Inventors: Albert Sobey, Jr., Bloomfield Hills, MI (US); John Brock, Auburn, MI (US); Alexander Craig, Bloomfield Hills, MI (US)

(73) Assignee: PDT, LLC, Bloomfield Hills, MI (US)

( * ) Notice: Subject to any disclaimer, the term of this patent is extended or adjusted under 35 U.S.C. 154(b) by 23 days.

(21) Appl. No.: 16/014,339

(22) Filed: Jun. 21, 2018

(65) Prior Publication Data

US 2018/0371910 A1 Dec. 27, 2018

Related U.S. Application Data

(60) Provisional application No. 62/524,822, filed on Jun. 26, 2017.

(51) Int. Cl.
*F01C 1/22* (2006.01)
*F01C 21/08* (2006.01)
(Continued)

(52) U.S. Cl.
CPC ..... *F01C 1/22* (2013.01); *F01C 19/10* (2013.01); *F01C 21/0809* (2013.01);
(Continued)

(58) Field of Classification Search
CPC ..... F02B 37/183; F02B 37/02; F02B 37/186; F02B 37/18; F02B 37/013; F02B 37/04; F16K 1/2021
See application file for complete search history.

(56) References Cited

U.S. PATENT DOCUMENTS 885,006 A * 4/1908 Barnes ..... F02B 53/00 123/229
1,136,409 A * 4/1915 Conrady ..... F01C 1/32 418/61.1
(Continued)

FOREIGN PATENT DOCUMENTS

CA 988035 A 4/1976
DE 3321631 A1 12/1984
(Continued)

*Primary Examiner* — Patrick D Maines
(74) *Attorney, Agent, or Firm* — Vivacqua Law, PLLC

(57) ABSTRACT

A continuously variable turbine includes a case assembly with a case body defining a chamber, a rotor assembly positioned in the chamber, and a pair of valve assemblies. The rotor assembly includes a ring piston and a rotor body positioned within the ring piston. The rotor body is connected to a shaft, and the rotor body rotates concentrically about an axis extending through the shaft while the ring piston rotates eccentrically about the axis. Each valve assembly is positioned outside of the ring piston relative to the rotor assembly and includes a valve body and a seal component attached to the valve body. Each seal component has a surface with a curvature that matches the outer curvature of the ring piston to form a continuous surface seal between the seal component and the ring piston as the ring piston rotates eccentrically about the axis. The position of the continuous surface seals in the chamber defining a first sub-chamber and a second sub-chamber between the surface seals. The case body includes an intake port and an exhaust port for each sub-chamber.

9 Claims, 7 Drawing Sheets

(51) Int. Cl.

| | |
|---|---|
| ***F01C 19/10*** | (2006.01) |
| ***F02B 53/06*** | (2006.01) |
| ***F03C 2/30*** | (2006.01) |
| *F01B 13/02* | (2006.01) |
| *F04C 2/356* | (2006.01) |

(52) U.S. Cl.

CPC ..... *F02B 53/06* (2013.01); *F03C 2/304* (2013.01); *F01B 13/02* (2013.01); *F01C 21/08* (2013.01); *F04C 2/3562* (2013.01); *F04C 2240/20* (2013.01)

(56) References Cited

U.S. PATENT DOCUMENTS

| | | | | |
|---|---|---|---|---|
| 1,434,446 | A * | 11/1922 | McQueen | F02B 53/00 123/228 |
| 2,198,130 | A | 4/1940 | Schweiger | |
| 2,418,793 | A | 4/1947 | Selden | |
| 2,742,882 | A | 4/1956 | Porter | |
| 2,920,814 | A | 1/1960 | Breelle | |
| 3,322,103 | A | 5/1967 | Dirnberger | |
| 3,584,984 | A | 6/1971 | Majkowski et al. | |
| 3,799,126 | A | 3/1974 | Park | |
| 3,935,840 | A | 2/1976 | Fisher | |
| 4,057,035 | A | 11/1977 | Su | |
| 4,080,935 | A * | 3/1978 | Olson | F01C 1/46 123/205 |
| 6,868,822 | B1 | 3/2005 | Di Pietro | |
| 8,579,615 | B2 | 11/2013 | Akmandor | |
| 2009/0081065 | A1 | 3/2009 | Radziwill | |
| 2010/0143174 | A1 | 6/2010 | Radziwill et al. | |
| 2010/0194111 | A1 * | 8/2010 | Van Den Bossche | F01K 3/247 290/2 |

FOREIGN PATENT DOCUMENTS

| | | |
|---|---|---|
| EP | 2495396 A1 | 9/2012 |
| WO | 2012042407 A2 | 4/2012 |

* cited by examiner

CONTINUOUSLY VARIABLE TURBINE

RELATED APPLICATION

The present application claims the benefit of U.S. Provisional Patent Application No. 62/524,822, filed on Jun. 26, 2017, the entire contents of which are incorporated herein by reference.

INTRODUCTION

The present disclosure relates to a continuously variable turbine.

A turbine is a rotary device that extracts energy form a fluid a converts it into useful work. Many types of turbines have been developed in the past. Various types of turbines include steam turbines, wind turbines, gas turbines and water turbines.

In some turbines, a set of blades or vanes are positioned about a shaft or spindle. The blades or vanes are arranged such that flow of fluid through the blades or vanes causes the blades or vanes to move thereby causing the shaft or spindle to rotate. The turbine may be connected machinery such as a pump, compressor or components of a propulsion system. The work produced by the turbine can be utilized for generating power when coupled with a generator or producing thrust, for example, from jet engines.

While current turbines achieve their intended purpose, there is a need for a new and improved turbine with higher efficiencies.

SUMMARY

According to several aspects, a continuously variable turbine includes a case assembly with a case body defining a chamber, a rotor assembly positioned in the chamber, and a pair of valve assemblies. The rotor assembly includes a ring piston and a rotor body positioned within the ring piston. The rotor body is connected to a shaft, and the rotor body rotates concentrically about an axis extending through the shaft while the ring piston rotates eccentrically about the axis. Each valve assembly is positioned outside of the ring piston relative to the rotor assembly and includes a valve body and a seal component attached to the valve body. Each seal component has a surface with a curvature that matches the outer curvature of the ring piston to form a continuous surface seal between the seal component and the ring piston as the ring piston rotates eccentrically about the axis. The position of the continuous surface seals in the chamber defining a first sub-chamber and a second sub-chamber between the surface seals. The case body includes an intake port and an exhaust port for each sub-chamber.

In an additional aspect of the present disclosure, the seal component of each valve assembly is an articulating seal component relative to the valve body to maintain the continuous surface seal between the seal component and the ring piston.

In another aspect of the present disclosure, each valve assembly includes at least at least one biasing member that urges the seal component against the ring piston.

In another aspect of the present disclosure, each valve body has flow channels that communicate with the intake port for one of the sub-chambers and the exhaust port for the other sub-chamber.

In another aspect of the present disclosure, the rotor body maintains three regions of contact with the ring piston.

In another aspect of the present disclosure, each region of contact is a pair of bearings.

In another aspect of the present disclosure, the case assembly includes a pair of manifolds, each manifold including the intake port for one of the sub-chambers and the exhaust port for the other sub-chamber.

In another aspect of the present disclosure, each manifold includes a slot in which a respective valve body reciprocates.

In another aspect of the present disclosure, the turbine operates as a compressor.

In another aspect of the present disclosure, the turbine operates as an engine.

In another aspect of the present disclosure, the continuous seals maintain a seal between the seal component and the ring piston for controlling working pressures in each sub-chamber up to about 3000 psi.

According to several aspects, a multi-stack turbine includes at least two continuously variable turbines, each turbine including a case assembly with a case body defining a chamber; a rotor assembly positioned in the chamber and including a ring piston and a rotor body positioned within the ring piston, the rotor body being connected to a shaft, the rotor body rotating concentrically about an axis extending through the shaft while the ring piston rotates eccentrically about the axis; and a pair of valve assemblies, each valve assembly being positioned outside of the ring piston relative to the rotor assembly, each valve assembly including a valve body and a seal component attached to the valve body, each seal component having a surface with a curvature that matches the outer curvature of the ring piston to form a continuous surface seal between the seal component and the ring piston as the ring piston rotates eccentrically about the axis, the position of the continuous surface seals in the chamber defining a first sub-chamber and a second sub-chamber between the surface seals, the case body including an intake port and an exhaust port for each sub-chamber.

In another aspect of the present disclosure, the seal component of each valve assembly is an articulating seal component relative to the valve body to maintain the continuous surface seal between the seal component and the ring piston.

In another aspect of the present disclosure, the turbine operates as a compressor.

In another aspect of the present disclosure, the turbine operates as an engine.

In another aspect of the present disclosure, the continuous seals maintain a seal between the seal component and the ring piston for pressures in each sub-chamber up to about 3000 psi.

According to several aspects, a valve assembly for a turbine includes a valve body and a seal component attached to the valve body, the valve assembly being positioned outside of a ring piston positioned in a chamber of the turbine. The seal component has a surface with a curvature that matches the outer curvature of the ring piston to form a continuous surface seal between the seal component and the ring piston as the ring piston rotates eccentrically about an axis of rotation.

In another aspect of the present disclosure, the seal component is an articulating seal component relative to the valve body to maintain the continuous surface seal between the seal component and the ring piston.

In another aspect of the present disclosure, the valve assembly includes at least at least one biasing member that urges the seal component against the ring piston.

According to several aspects, a thermal engine includes a cooling unit, a thermal exchange unit that transfers heat to the cooling unit, a pump that receives cooled fluid from the thermal exchange unit, a heating unit that receives the cooled fluid from the pump, and an expander that receives high pressure heated fluid from the heating unit and transmits low pressure heated fluid to the thermal exchange unit. The pump and the expander each include a case body defining a chamber, a ring piston positioned in the chamber and a rotor body positioned within the ring piston, the rotor body rotating concentrically about an axis of rotation while the ring piston rotates eccentrically about the axis, and a pair of valve assemblies, each valve assembly being positioned outside of the ring piston, each valve assembly including a valve body and a seal component attached to the valve body. Each seal component has a surface with a curvature that matches the outer curvature of the ring piston to form a continuous surface seal between the seal component and the ring piston as the ring piston rotates eccentrically about the axis of rotation. The position of the continuous surface seals in the chamber defining a first sub-chamber and a second sub-chamber between the surface seals. The case body including an intake port and an exhaust port for each sub-chamber.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
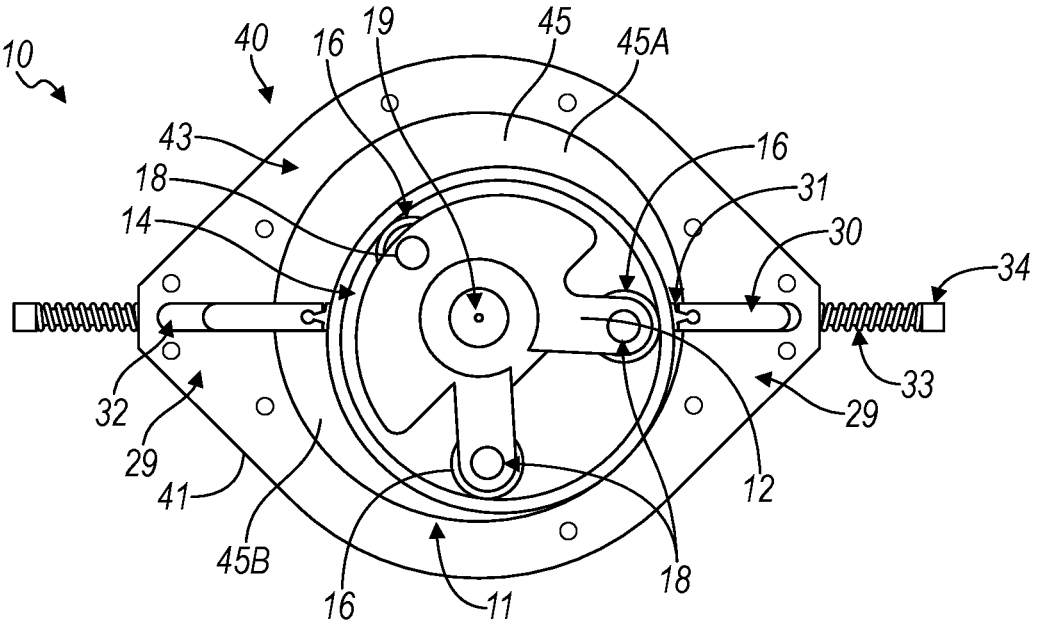
FIG. 1 is a top view of a continuously variable turbine in accordance with the principles of the present disclosure.
Figure 2:
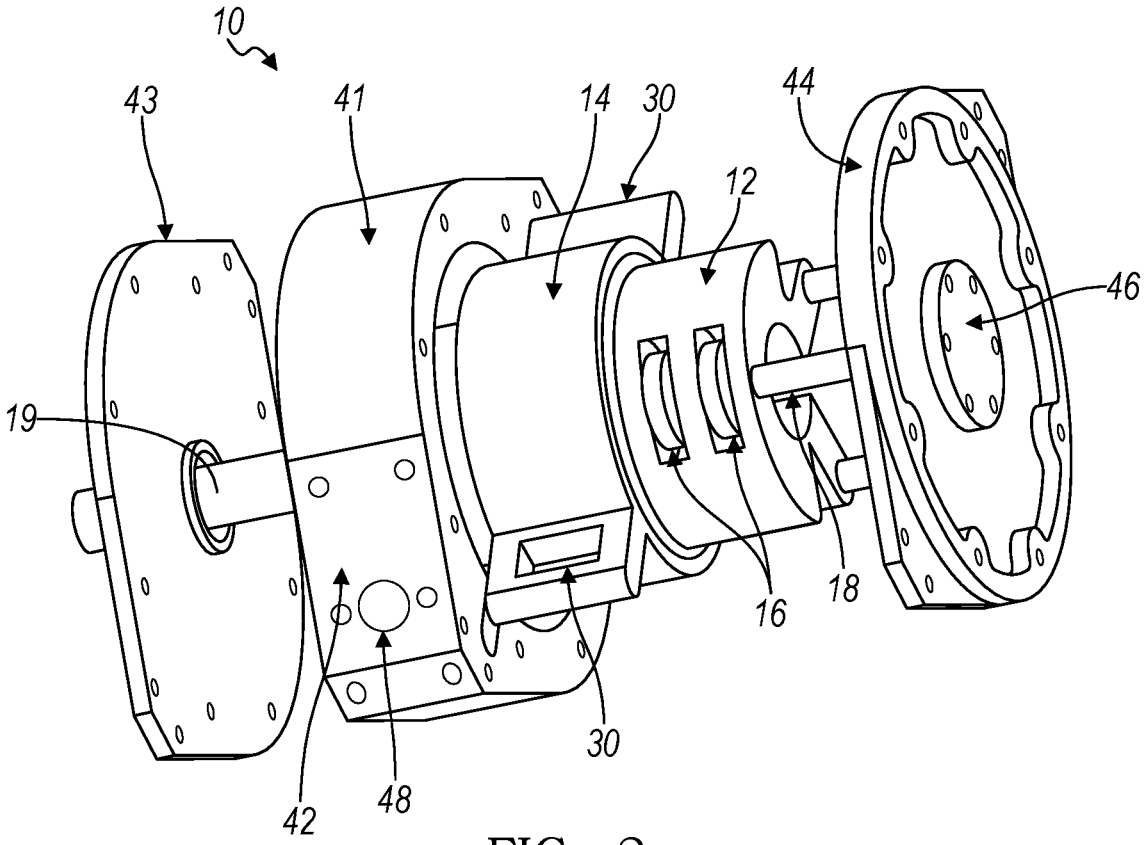
FIG. 2 is an exploded view of the turbine shown in FIG. 1.

Referring to FIGS. 1 and 2, there is shown a continuously variable turbine 10. The turbine 10 includes a rotor assembly 11, a valve assembly 29 and a case assembly 40. The case assembly 40 includes a case body 40 with chamber 45. The rotor assembly 11 includes a ring piston 14 positioned in the chamber 45 and a rotor body 12 mounted on a shaft 19 and positioned within the ring piston 14.

Figure 7:
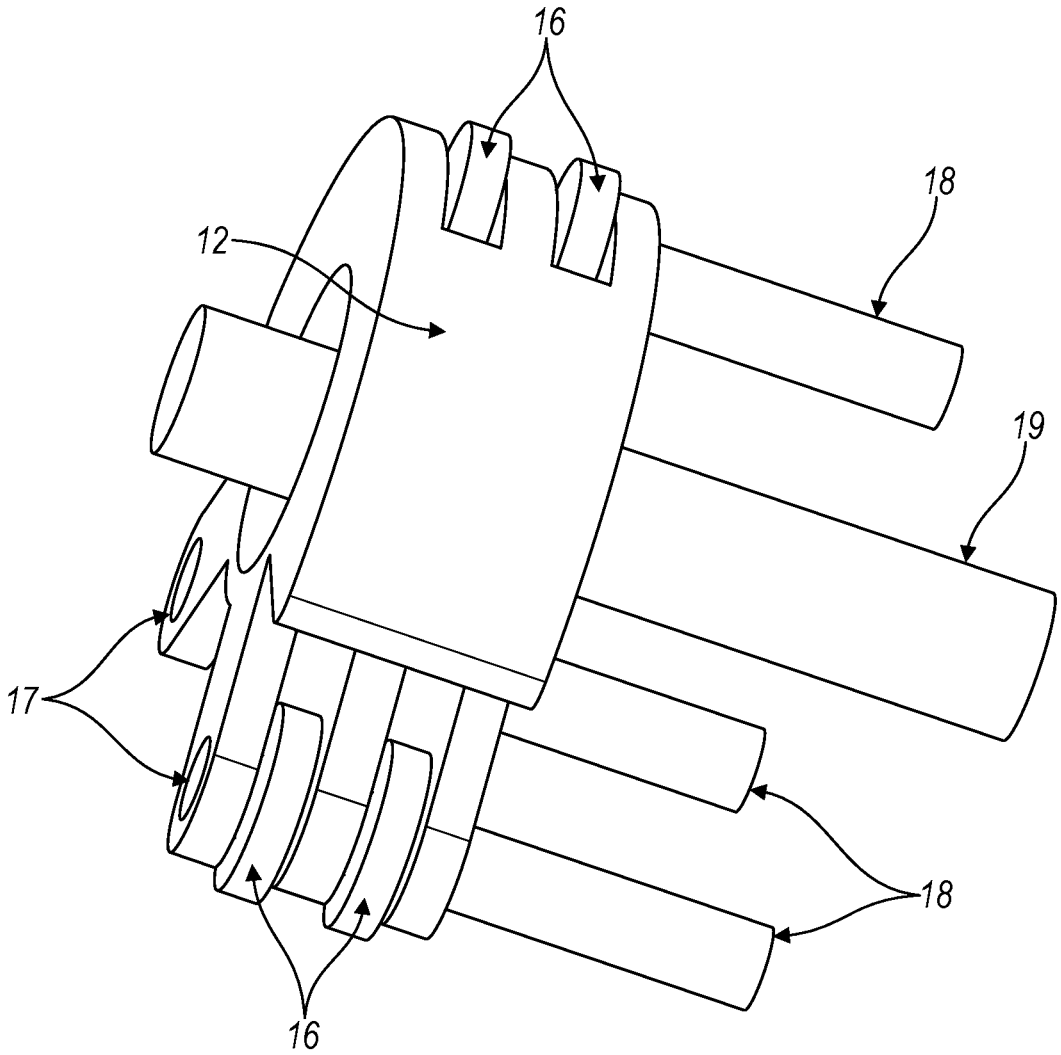
FIG. 7 is a perspective view of a rotor assembly for the turbine shown in FIG. 1.

Referring also to FIG. 7, a set of bearing shafts 17 extend through respective bearing holes 17 in the rotor body 12. A pair of bearings 16 are mounted on each bearing shaft 17. Note that the present disclosure is not limited to the use of two bearings on each shaft. In some configurations, a single bearing 16 may be mounted on each shaft 17, while in other configurations, three or more bearings 16 may be mounted on each shaft 17.

As shown in FIG. 1, each pair of bearings 16 makes contact with the inner surface of the ring piston 14 such that there are three contact regions between the rotor body 12 and the inner surface of the ring piston 14. Two of the bearing shafts 18 are positioned further away from an axis of rotation extending through the shaft 19 than the third shaft 18. Accordingly, as the rotor body 12 rotates concentrically about the axis of rotation, the piston ring 14 rotates eccentrically about the axis of rotation.

Figure 3:
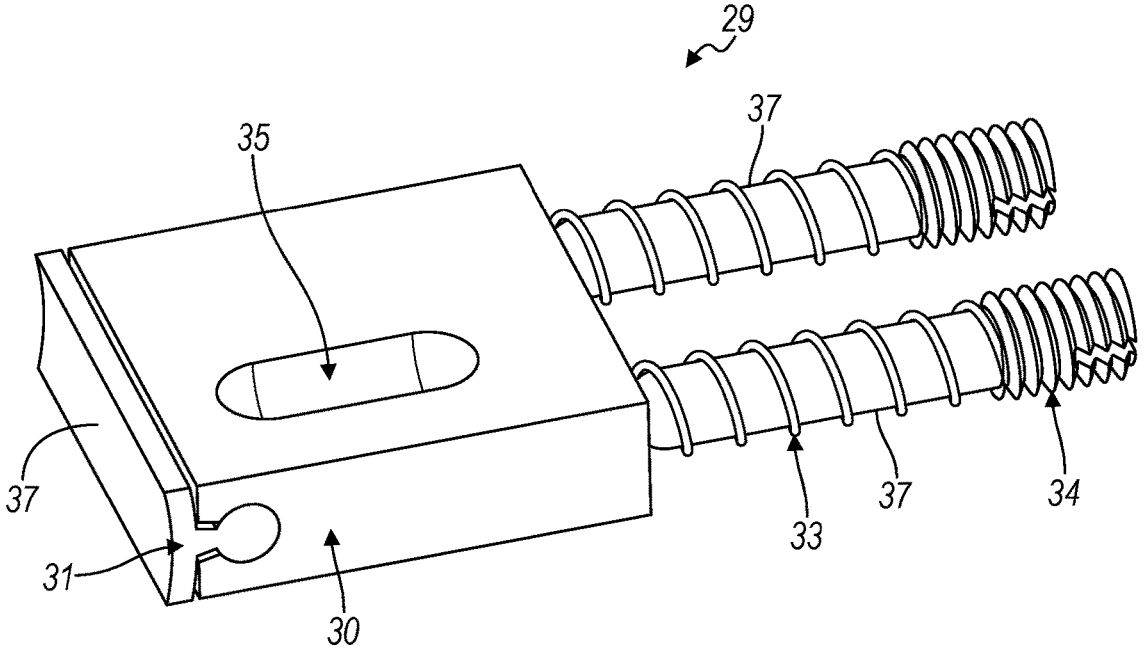
FIG. 3 is a perspective view of a valve assembly for the turbine shown in FIG. 1.
Figure 4:
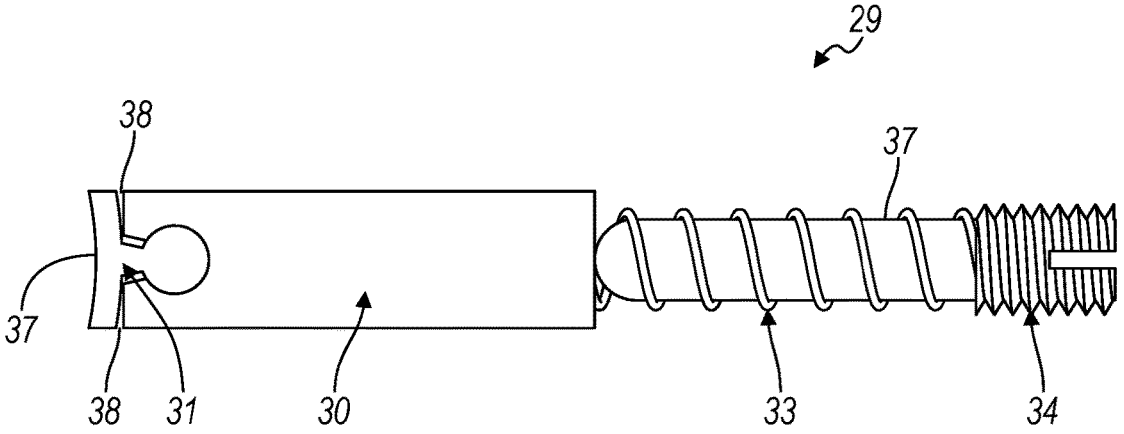
FIG. 4 is a side view of the valve assembly shown in FIG. 3.
Figure 5:
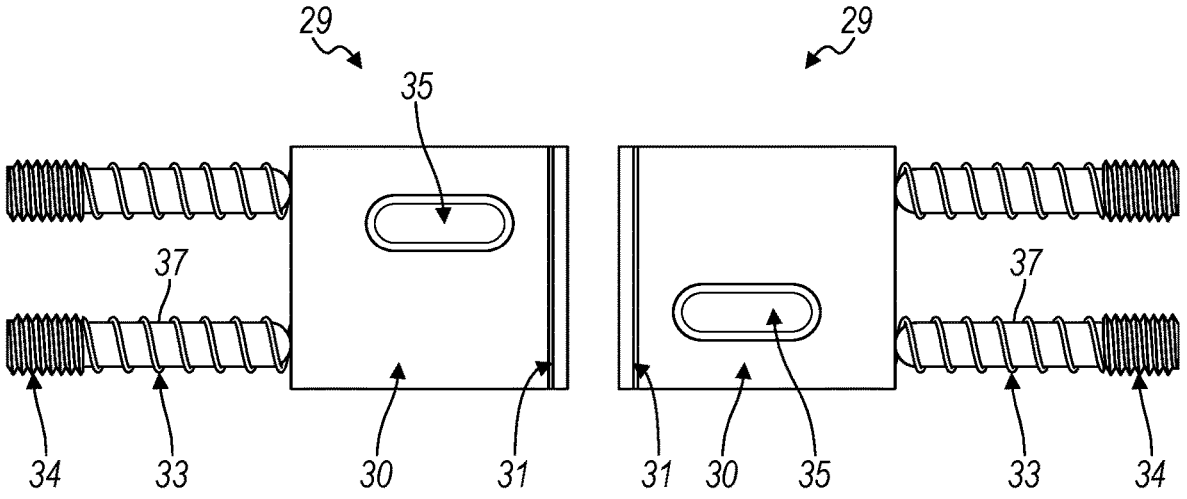
FIG. 5 illustrates two valve assemblies.
Figure 6:
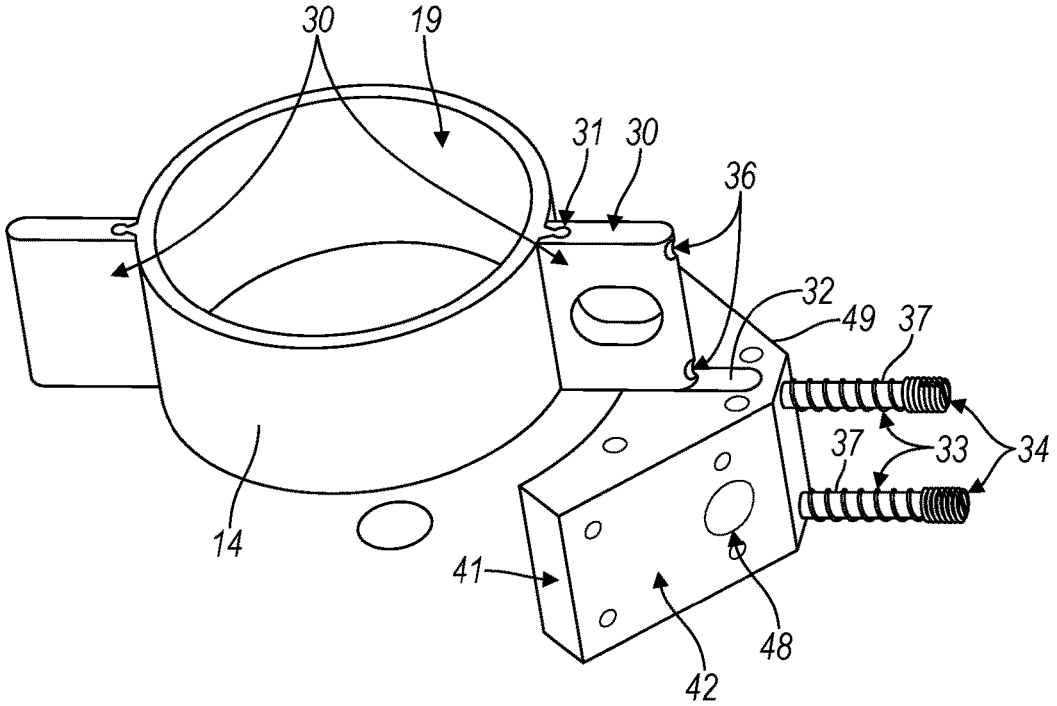
FIG. 6 is an exploded view of the valve assemblies and a ring piston of the turbine shown in FIG. 1.

The case assembly 40 includes a pair of manifolds 41 as shown in FIG. 6. Each valve assembly 29 includes a valve body 30 positioned in a slot 32 of a respective manifold 41. As shown in FIGS. 3, 4 and 5, the valve assembly 29 further includes a pair of valve shafts 37 that extend through the manifold 41 and engage with retainers 34. A spring 33 is positioned about each valve shaft 37 between eh valve body 30 and the retainer 34, and the shafts 37 are able to reciprocate in respective channels 36 in the valve body 30. Accordingly, as the valve body 30 reciprocates outwardly and inwardly in the slot 32 relative to the axis of rotation of the shaft 19, the valve shafts 32 reciprocate in the channels 36 causing the springs 33 to compress and expand. A bottom plate 43 and a top plate 44 are matted and secured to the case body 41 to enclose the rotor assembly 11 and the valve assemblies 29 in the case body 41. The shaft 19 can extend through an opening in either or both the bottom plate 43 and the top plate 44. For example, as shown in FIG. 2, the shaft 19 extends through the bottom plate 43 while a bearing cap is employed to cover the opening in the top plate 44.

The valve assembly 29 also includes a seal component 31 attached to the seal body 30. Each seal component 31 has a curved surface or face 37 that corresponds to or matches the curvature of the outer surface of the ring piston 14. The springs 33 are pre-loaded so that there is continuous contact between the seal component 31 and the ring piston 14 as the ring piston 14 rotates eccentrically about the axis of rotation of the shaft 19. The seal component 31 articulates relative to the seal body 30. That is, the seal component 31 is able to move relative to the seal body 30 to fill the gaps 38 shown in FIG. 4 to ensure there is a continuous surface seal between the curved face 37 of the seal component 31 and the ring piston 14.

Each manifold 41 includes an intake port 48 and an exhaust port 49. The position of the surface seals formed by the seal components 31 define sub-chambers 45*a* and 45*b*. The robustness of the surface seals formed by the seal components 31 allow the sub-chambers 45*a* and 45*b* to withstand working pressures up to about 3000 psi without damaging or compromising the surface seals. Each valve body 30 includes a flow channel 35 to allow each chamber 45*a* and 45*b* to communicate with respective intake and exhaust ports 48 and 49.

The various components of the turbine can be made from any suitable material, such as, for example, metals and plastics. The metals can be selected, for example, from any combination of aluminum, steel, and titanium. In particular, the seal component 31 can be made from silicone.

Figure 8:
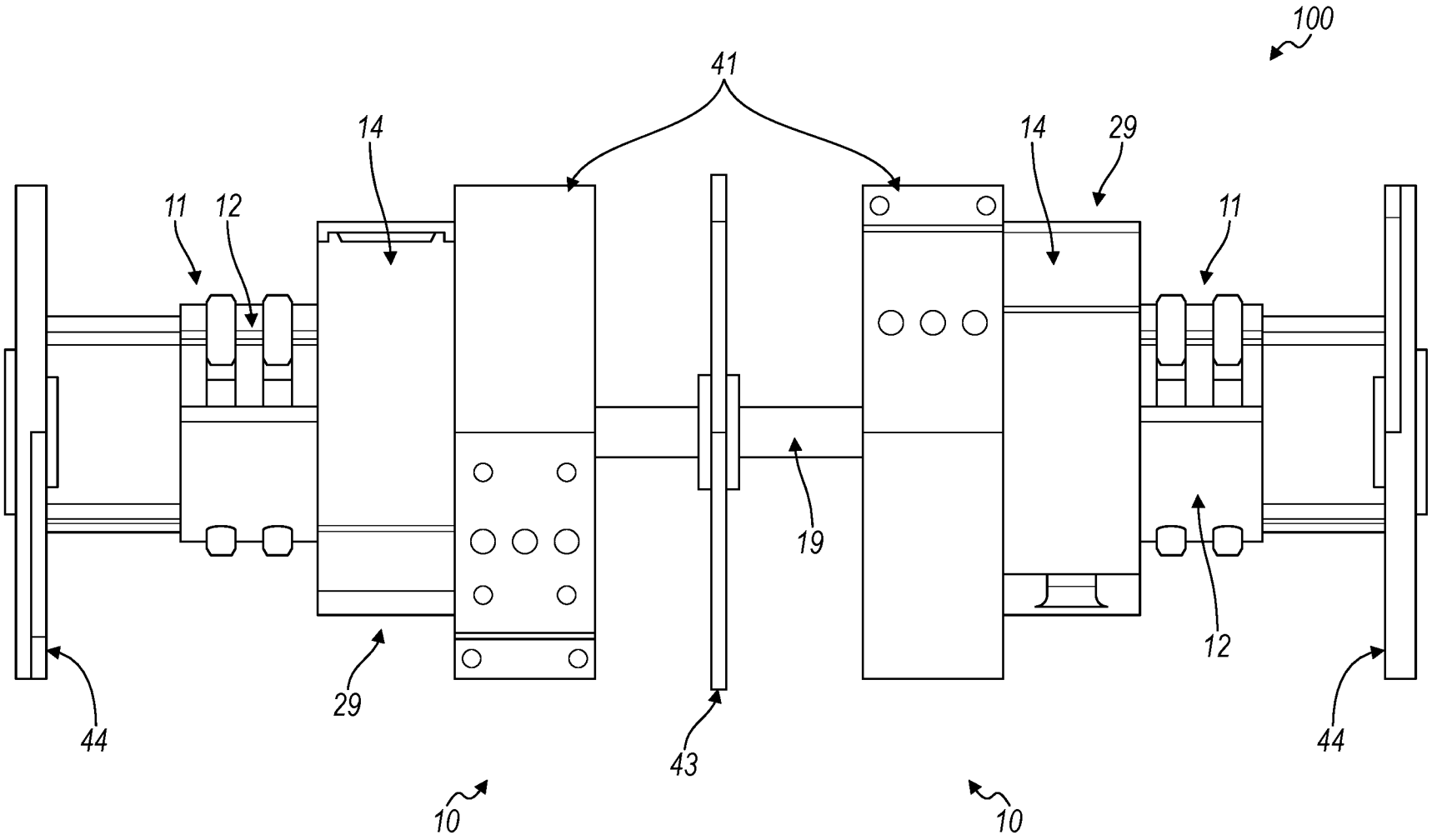
FIG. 8 is an exploded view of a multi-stack turbine in accordance with the principles of the present disclosure.

Depending upon its use, a single turbine 10 can be employed or two or more turbine can be stacked together for higher output capabilities. For example, two turbines 10 are shown in a staked arrangement in FIG. 8. In this configuration, a single bottom plate 43 is employed as a divider between the two turbines 10, and a pair of top plates 44 are employed to encase the two rotor assemblies 11 and the two valve assemblies 29 in their respective case bodies 41.

Figure 9:
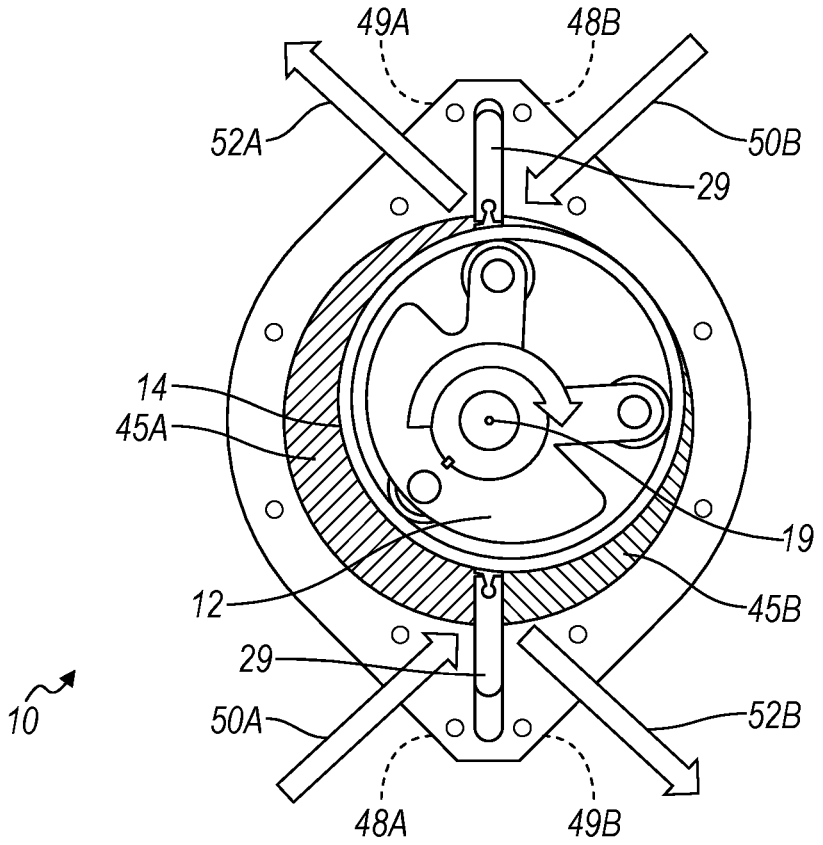
FIG. 9 shows the turbine of FIG. 1 operating as a compressor.

Turning now to FIG. 9, there is shown the turbine 10 utilized as a compressor. Specifically, as the shaft 19 is rotated (for example, by a motor), the rotor assembly 12 and the ring piston 14 rotate about the axis of rotation of the shaft 19. Accordingly, inlet fluid 50*a* is drawn into the sub-chamber 45*a* though its respective intake port 48*a*. The fluid is compressed as the ring piston 14 rotates clockwise such that high pressure gas 52*a* is exhausted through the exhaust port 49*a* associated with the sub-chamber 45*a*. Similarly, inlet fluid 50*b* is drawn into the sub-chamber 45*b* through its intake port 48*b*. The fluid is compressed such that high pressure fluid 52*b* is exhausted through the exhaust port 49*b* associated with the sub-chamber 45*b*.

Figure 10:
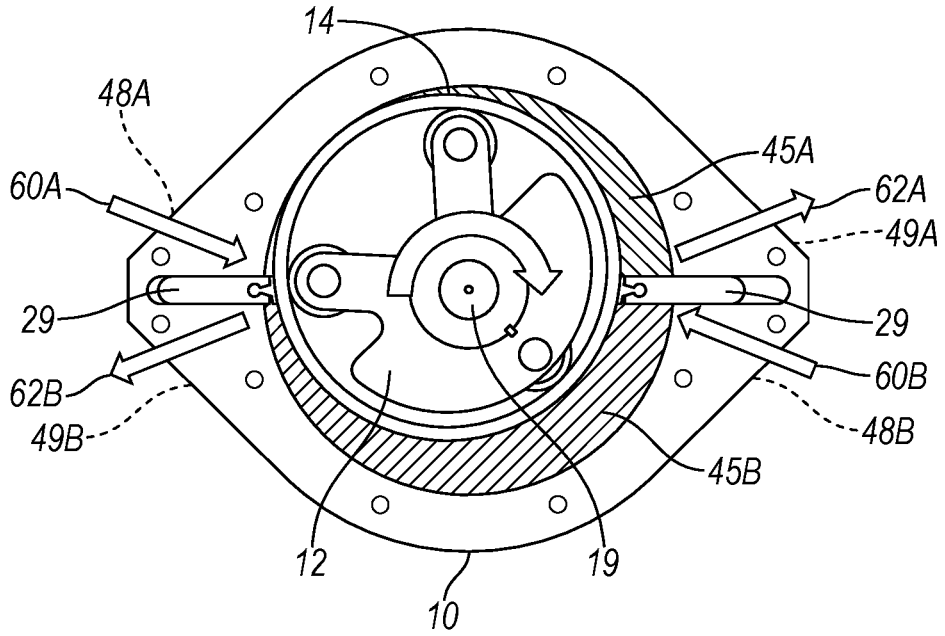
FIG. 10 shows the turbine of FIG. 1 operating as a motor.

The turbine 10 can also be utilized as a motor as shown in FIG. 10. In this arrangement, high pressure fluid 60*a* and 60*b* are injected through the intake ports 48*a* and 48*b* into the respective sub-chambers 45*a* and 45*b*. The expansion of the fluid cause the rotor body 12 and the ring piston 14 to rotate clockwise such that the expanded fluid 62*a* is exhausted from the sub-chamber 45*a* and the expanded fluid 62*b* is exhausted from the sub-chambers 45*b* through the exhaust ports 49*a* and 49*b*, respectively. Rotation of the rotor body 12 generates a torque on the shaft 19, which can be connected to any suitable device that can utilize the output torque from the turbine 10.

Figure 11:
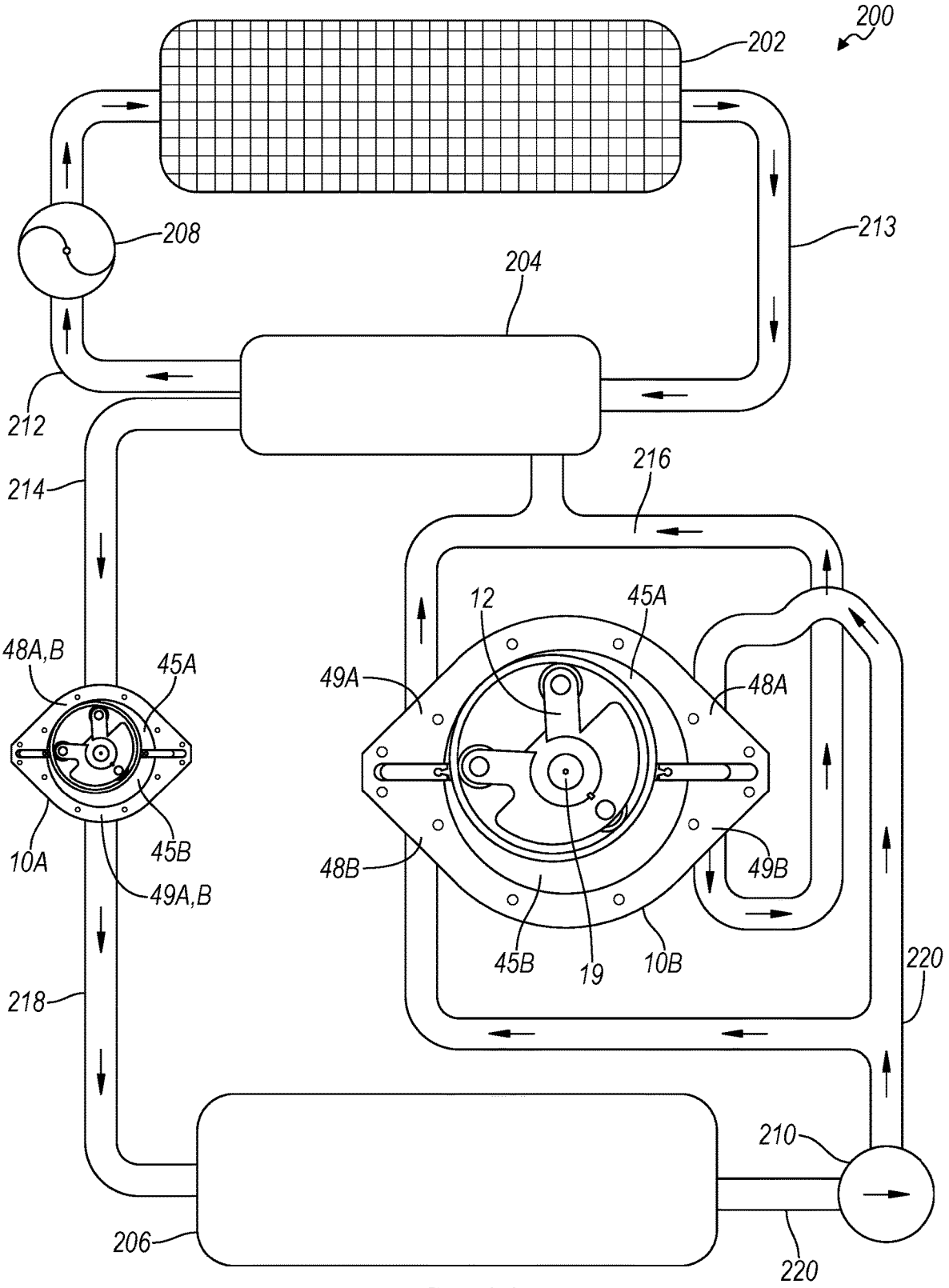
FIG. 11 shows a thermal engine with two of the turbines shown in FIG. 1 in accordance with the principles of the present disclosure.

In another configuration, multiple turbines 10 can be utilized in a thermal engine 200 as shown in FIG. 11. The thermal engine 200 includes a cooling unit 202, a thermal exchange unit 204 that transfers heat to the cooling unit 202, a pump 10A that receives cooled fluid from the thermal exchange unit 204, a heating unit 206 that receives the cooled fluid from the pump 10A, and an expander 10B that receives high pressure heated fluid from the heating unit 206 and transmits low pressure heated fluid to the thermal exchange unit 204.

Both the pump 10A and the expander 10B are the same as the aforementioned turbine 10. Each is sized according to their desired function and operation. Each of the pump 10A and the expander 10B may be a single turbine, or each or both may be a multi-stacked turbine described previously. In operation, the pump 10A receives the cooled fluid from the thermal exchange unit 204 through a fluid line 214. The pump 10A receives the fluid through the intake ports 48*a* and 48*b* and pumps the fluid out of the respective sub-chambers 45*a* and 45*b* into the fluid line 218 via the exhaust ports 49*a* and 49*b*. The fluid is transmitted through the fluid line 218 to the thermal heating unit 206 where the fluid is heated. The high pressure heated fluid is transmitted from the thermal heating unit 206 to the expander 10A through fluid lines 220.

The high pressure heated fluid enters into the sub-chambers 45*a* and 45*b* of the expander 10B through the intake ports 48*a* and 48*b*, respectively. The expanded fluid leaves the sub-chambers 45*a* and 45*b* through the exhaust ports 49*a* and 49*b* and is transmitted to the thermal exchange unit 204. The rotation of the rotor body 12 of the expander 10B generates torque than can be transmitted via the shaft 19 to any desired machinery coupled to the shaft 19.

The thermal exchange unit 204 transfers the heat in the fluid from the expander 10B into the fluid circulating in fluid lines 212 and 213. More specifically, a circulation pump 208 draws the fluid from the thermal exchange unit 204 through the fluid line 212 and transmits it to the cooling unit 202. The cooled fluid is then pumped back to the thermal exchange unit 204 through the fluid line 213.

Note that the fluid flowing through the fluid lines 212 and 213 defines a first closed circuit of fluid flow, and the fluid flowing through the fluid lines 214, 218, 220 and 216 defines a second closed circuit of fluid flow. A control unit 210 may be utilized to control the operation of the thermal engine 200.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A thermal engine comprising:

a cooling unit;

a thermal exchange unit that transfers heat to the cooling unit;

a pump that receives cooled fluid from the thermal exchange unit;

a heating unit that receives the cooled fluid from the pump; and an expander that receives high pressure heated fluid from the heating unit and transmits low pressure heated fluid to the thermal exchange unit, the pump and the expander each including:

a case body defining a chamber;

a ring piston positioned in the chamber and a rotor body positioned within the ring piston, the rotor body rotating concentrically about an axis of rotation while the ring piston rotates eccentrically about the axis; and a pair of valve assemblies, each valve assembly being positioned outside of the ring piston, each valve assembly including a valve body and a seal component attached to the valve body, each seal component having a surface with a curvature that matches the outer curvature of the ring piston to form a continuous surface seal between the seal component and the ring piston as the ring piston rotates eccentrically about the axis of rotation, the position of the continuous surface seals in the chamber defining a first sub-chamber and a second sub-chamber between the surface seals, the case body including an intake port and an exhaust port for each sub-chamber.

2. The thermal engine of claim 1 wherein the seal component of each valve assembly is an articulating seal component relative to the valve body to maintain the continuous surface seal between the seal component and the ring piston.

3. The thermal engine of claim 1 wherein each valve assembly includes at least at least one biasing member that urges the seal component against the ring piston.

4. The thermal engine of claim 1 wherein each valve body has flow channels that communicate with the intake port for one of the sub-chambers and the exhaust port for the other sub-chamber.

5. The thermal engine of claim 1 wherein the each rotor body maintains three regions of contact with the respective ring piston.

6. The thermal engine of claim 5 wherein each region of contact is a pair of bearings.

7. The thermal engine of claim 1 wherein each case body includes a pair of manifolds, each manifold including the intake port for one of the sub-chambers and the exhaust port for the other sub-chamber.

8. The thermal engine of claim 7 wherein each manifold includes a slot in which a respective valve body reciprocates.

9. The thermal engine of claim 1 wherein the continuous seals maintain a seal between the seal component and the ring piston for controlling pressures in each sub-chamber up to 3000 psi.

* * * * *